United States Patent [19]

Weber

[11] 4,058,908

[45] Nov. 22, 1977

[54] APPARATUS FOR DRYING FLAT PRINTED MATERIAL

[76] Inventor: Erich Weber, 9a, Bertha Koempelstrasse, Feldafing, Germany

[21] Appl. No.: 686,102

[22] Filed: May 13, 1976

Related U.S. Application Data

[62] Division of Ser. No. 472,461, May 22, 1974, abandoned.

[30] Foreign Application Priority Data

May 22, 1973 Germany ..... 2326012
May 9, 1974 Germany ..... 2422492

[51] Int. Cl.[2] ..... F26B 15/22

[52] U.S. Cl. ..... 34/149; 34/151; 34/162; 34/163; 34/189; 198/478; 198/801

[58] Field of Search ..... 34/149, 151, 162, 163, 34/189; 214/1 B, 1 BB; 198/85, 134, 154

[56] References Cited

U.S. PATENT DOCUMENTS 1,736,866 11/1929 Wagner et al. ..... 198/134

*Primary Examiner*—John J. Camby
*Assistant Examiner*—Larry I. Schwartz

[57] ABSTRACT

An apparatus is provided for drying flat printed material such as paper and card sheets and the like, supports for the printed material being mounted on the chain links of the conveyor chains of an upright chain conveyor having a transfer path which is disposed in an upper reversal zone of the conveyor chains and on which the printed material is conveyed from a rising to a falling conveyor stringer. Conveying means are disposed on the conveying path of the printed material and comprise pusher elements and/or pull elements which can be reciprocated in the conveying plane and which act only on the trailing or leading ends of the printed material so as to push and/or pull the printed material over the conveying path.

19 Claims, 32 Drawing Figures

9
9
11
9
9
10
12
13
8
6
15
3
7
16
12
4
9
8
13'
6
12
8
12
10
α
10
48
9'
11
50
49
51
11

9
11
9
9
10
10
13
8
12
7
12
7
16
15
9
8
6
3
50
12
8
49
51
10
48
α
9'
9
11
11

APPARATUS FOR DRYING FLAT PRINTED MATERIAL

This is a division, of application Ser. No. 472,461 filed May 22, 1974 now abandoned.

The invention relates to apparatus for drying flat printed material such as paper and card sheets, plastics film or panels of board, timber, sheet metal or other material with printing material supports mounted on the chain links of the conveyor chains of a substantially upright chain conveyor and a transfer path which is disposed in the upper reversal zone of the conveyor chains and on which the printed material is conveyed from the rising to the falling conveyor stringer.

The printed material which arrives with the print still moist from a printing machine, for example a screen printing machine, is individually placed on the printed material support of the chain conveyor with the freshly printed side facing upwardly and must not be turned over until the printed inks, varnishes or the like have completely dried. To enable the descending conveyor stringer of such an upright drier to be utilized for the drying operation the printed material must not be reversed through 180° at the upper reversing position of the chain conveyor otherwise the side which is still moist and is downwardly orientated would bear upon the descending supports. For this reason the printed material is transferred from the top printing material support, which is rising but not yet reversed, transversely through the chain conveyor to the top printing material support which is descending and has just been reversed. This may give rise to difficulties which lead to stoppages in the operation of the drier and in turn call for shutting down the entire printing plant.

It is the object of the invention to eliminate these difficulties and to ensure transportation of the printed material over its transfer path over which the said printed material is conveyed so that it cannot stick at any position and collide with the succeeding piece of printed material.

According to the invention this problem is solved in that the conveying means which are disposed on the transfer path of the printed material at the top reversing point of the chain conveyor comprise push elements or/and pull elements which can be reciprocated in the feed plane and act merely on the trailing or leading end of the printed material and push and/or pull the printed material over the transfer path. This provides a high degree of reliability against stoppages in the operation of the drier.

According to one advantageous embodiment of the invention the push elements comprise slides whose advantageously bifurcated slide heads abut against the trailing transverse edge of the printed material. This embodiment offers the advantage that the edge surface of the printed material is not touched by the slide so that the printed material can be printed, inked, varnished or otherwise treated completely as far as the edge.

According to another advantageous embodiment of the invention pull elements in the form of grippers with gripper heads are used and are provided with clamping jaws or the like which grip the edge of the printed material to clamp it between them. This embodiment is particularly suitable for conveying thin printed material which is not stiff but in which the edge of the said printed material is to be neither printed nor inked.

In another embodiment of the invention push elements or slides and pull elements or grippers are combined, i.e. the printed material is first advanced by the slides beyond the middle zone of the transfer path where it is gripped by the grippers which pull it for the remaining distance of the transfer path into the limiting position. This embodiment offers the advantage that the operating motions of the push elements or pull elements can be shortened.

In one modification of the invention the printed material is gripped at its trailing edge and leading edge by clamping heads of grippers disposed on both sides. The printed material thus gripped is slightly raised and is floatingly conveyed over the transfer path so that its underside does not come into contact with the support surfaces.

The slides or grippers can be moved in any desired manner. Operation of such elements by pressure media such as compressed air is particularly appropriate and simple according to the invention, suitable pressure medium cylinders being provided whose piston rods are coupled to the slides or grippers. The required timing can be easily obtained in known manner by means of valves or spools.

Slide plates which have interruptions to permit the passage of the slides or grippers can be provided according to the invention in the middle zone of the transfer path. The slide plates can be inclined in a specific manner in order to facilitate the transfer of the printed material.

In a particularly advantageous embodiment of the invention the support bars which comprise the printed material supports are provided with offset zones at the ends nearest to the chain conveyor so that the printed material support is retained at a level which is advantageous for the action of the slides or grippers. At the outer, free ends the support bars are bent to form stop fence edges which ensure the desired vertical distance from the printed material supports.

The uppermost printed material support of the rising conveyor stringer which conveys the printed material through the slides to the other side of the chain conveyor in the previously mentioned embodiments of the printed material drier is situated horizontally and parallel above the succeeding printed material support disposed therebelow and at a relatively slight distance therefrom. It is possible that the intrinsically flat printed material, for example a sheet or card or a plastics panel, is slightly bowed, curved or distorted. It would then be possible for the slide or the slide head to come into contact with the bottom printed material in the narrow compartment between the aforementioned printed material supports to damage or scratch the said printed material or to push it in front together with the printed material at the top and to push it into the conveyor chain. This would interfere with the operation of the drier. The chain conveyor would have to be immediately shut down so that the fault could be eliminated. This would however also interrupt the operation of the entire printing plant for a prolonged period of time. For example, if plates with printed electric circuits are dried in the drier housing at a temperature of approximately 150° to 200° C it would be necessary to allow the drier to cool down before the fault could be eliminated or the chain conveyor repaired, a procedure which occupies a great deal of time.

It is also difficult and costly to produce the apparatus with such narrow tolerances of the compartment spacings that the slide heads always accurately grip the printed material disposed on the top printed material support without reaching too deeply under the said printed material support.

These disadvantages are eliminated according to a further advantageous embodiment of the invention in that the top printed material support of the rising conveyor stringer of the chain conveyor is downwardly inclined with respect to the descending conveyor stringer while the printed material is conveyed to form an angle of inclination with respect to the next printed material support which is disposed horizontally below.

This ensures that more space is provided between the top printed material support and the printed material support disposed therebelow so that the pusher elements are provided with a wider tolerance range. Accordingly, the pusher elements cannot in practice collide with the printed material disposed below, even if this is curved or distorted and on the other hand they are able to grip the printed material disposed at the top more reliably to convey it to the other side of the chain conveyor.

According to one embodiment of the invention the pusher elements can comprise slides which are inclined at an angle and move between the individual support bars of the uppermost printing material support in the inclined plane thereof.

A further improvement can be achieved according to the invention if the slide elements comprise vertically disposed push rods which move horizontally between the individual support bars of the top printing material support which is inclined at an angle. This still further increases the tolerance range for gripping the printed material which is to be conveyed. The push rods can be moved more rapidly and impart acceleration to the printed material so that the push rods need only be advanced over the range of the uppermost printed material support which is inclined at an angle. According to the invention it will then be sufficient to provide circulating conveyor belts or rollers which are inclined at an angle and drive the printed material further to the horizontal printing material support between the inclined printing material support and the uppermost printing material support which waits in readiness on the other side of the chain conveyor. At the free end of the aforementioned printing material support the movement of the printing material can be stopped at the desired position by means of adjustable stop bars. The operating stroke of the push rods or slides can thus be substantially shortened to enable higher operating speeds to be obtained. Furthermore, the said push rods no longer move into the middle zone of the chain conveyor and cannot therefore be jammed or damaged at this position, thus avoiding further operating defects.

The slides, push rods and stop bars can be provided with resilient shock absorbers, for example with foam rubber pads. Further features of the invention will be described hereinbelow.

Different embodiments of the invention are illustrated in the accompanying drawing, in which.

Figure 1:
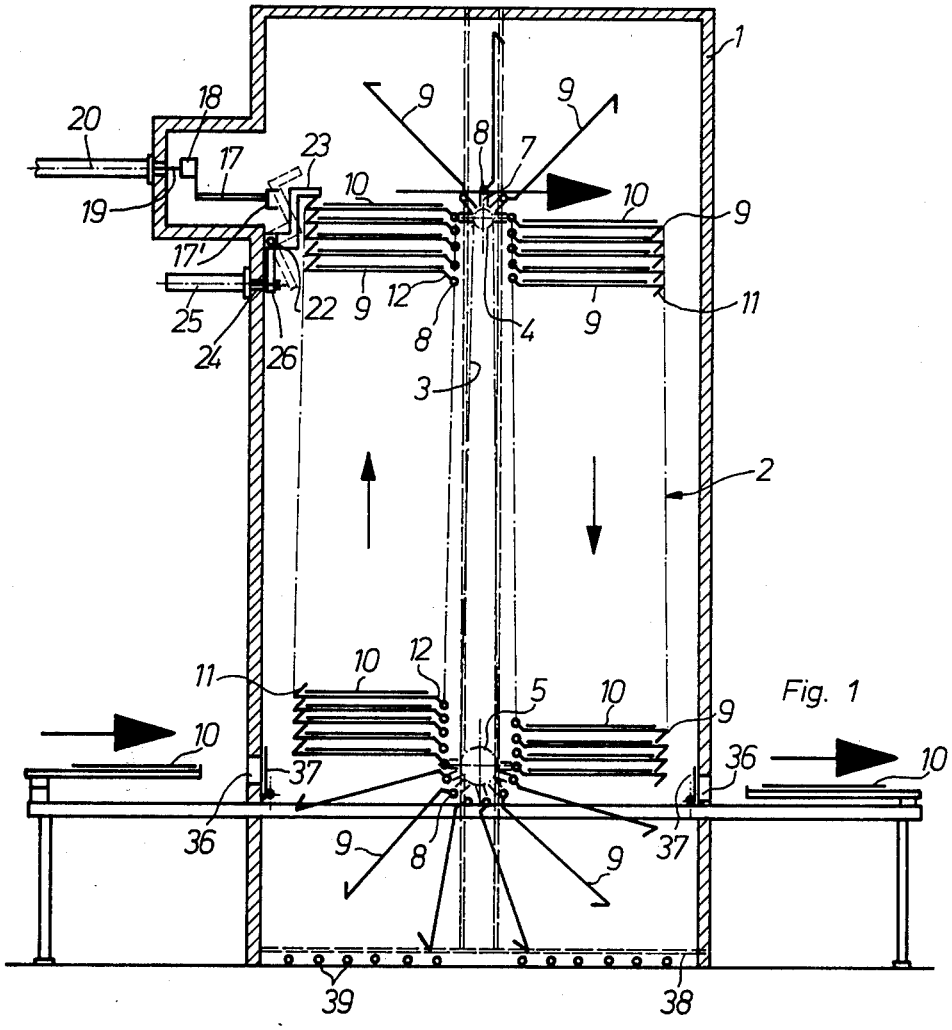
FIG. 1 is a vertical longitudinal section of a diagrammatically illustrated drier for printed material in which the arrangement of the printed material supports in the middle sections of the rising and descending conveyor stringer is merely indicated.

The drier for printed material which is shown diagrammatically in FIG. 1 comprises a housing 1 with a vertically upright chain conveyor 2 disposed therein whose conveyor chains 3 pass over top reversing sprockets 4 and bottom reversing sprockets 5. The conveyor chains 3 are set in motion by a motor which is not shown. The top chain sprockets 4 have a slightly smaller diameter than the bottom chain sprockets 5 and are coupled to each other by means of a shaft 40 (FIG. 6) in the same way as the chain sprockets 5.

Figures 2, 3, 4, 5:
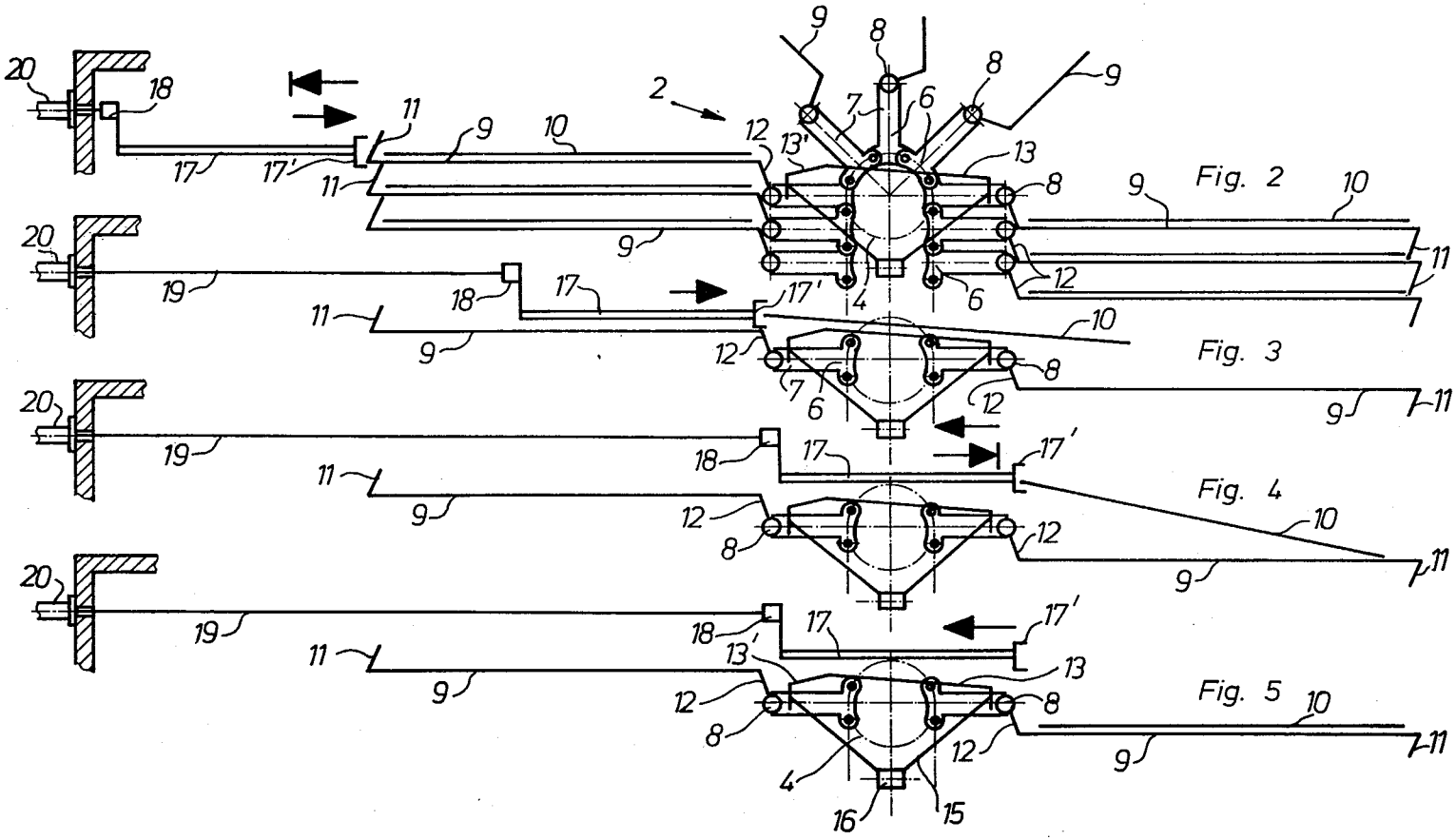
FIGS. 2 to 5 show to an enlarged scale and in diagrammatic form the upper reversing zone of the chain conveyor with its printed material pusher elements in different operating positions.
Figure 6:
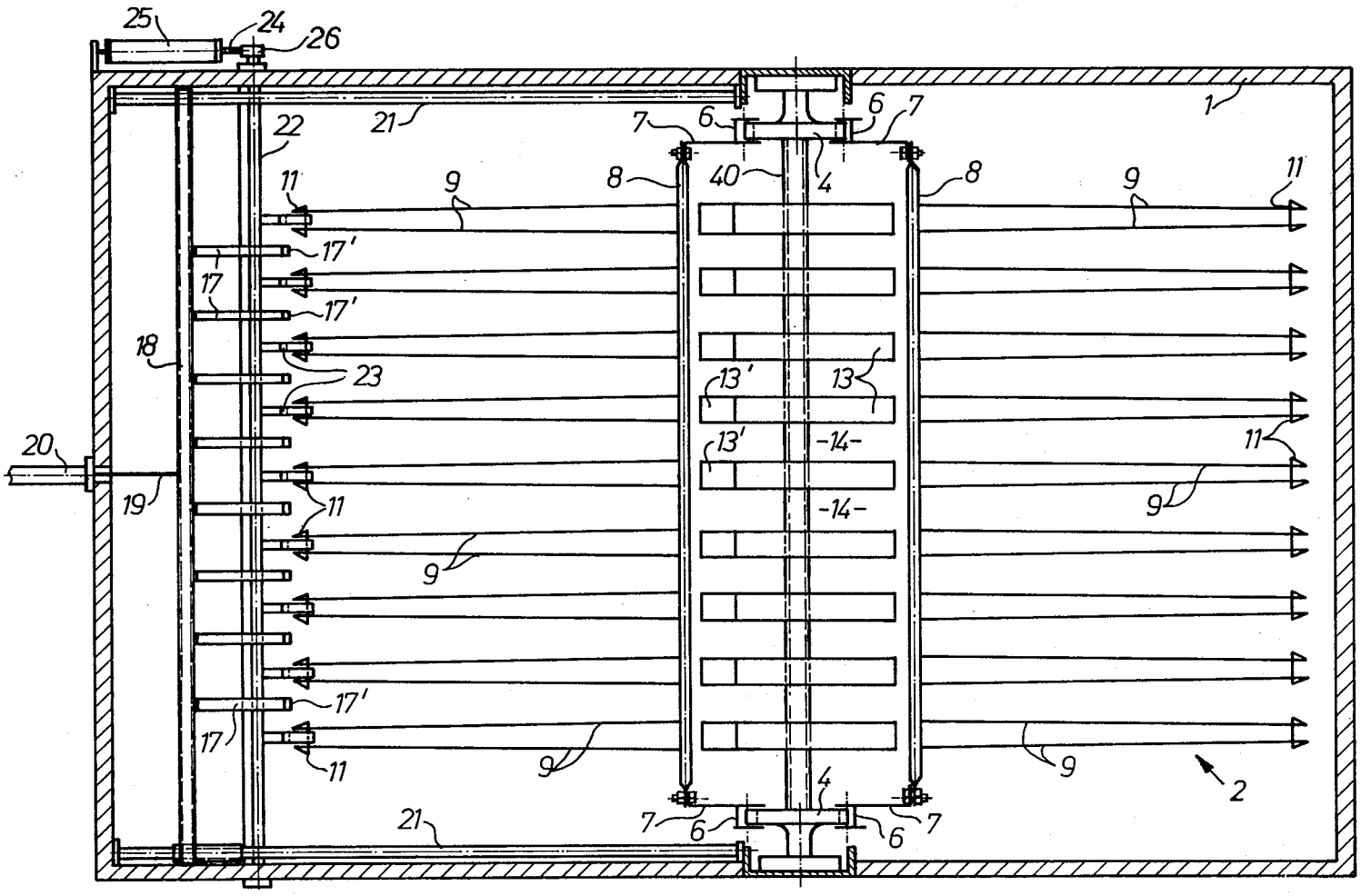
FIG. 6 is a horizontal cross-section showing a plan view of the upper reversing zone of the chain conveyor with the conveying path of the printed material.

Interchangeable intermediate members or links 7, which are positioned perpendicularly to the longitudinal extension of the chain links 7 are advantageously mounted on the said chain links 6 of the chain conveyors 3 as may be seen in detail by reference to FIGS. 2 and 6. Continuous retaining bars 8 are connected to the free ends of every two links 7 (FIG. 6) which are disposed on both sides of the chain conveyor 2. A printed material support, comprising a series of support bars 9, bent from wire or the like and adapted to support the printed material 10 in sheet or panel form, are mounted on each retaining bar 8. The free end of each support bar 9 is provided with an inwardly bent stop fence edge 11 which is upwardly orientated to the rising conveyor stringer (left-hand side of the chain conveyor 2) and is downwardly orientated on the descending conveyor stringer (right-hand side of the chain conveyor 2). The vertical height of the stop fence edge 11 corresponds to the mutual perpendicular distance between two successive support bars 9. At its end nearest to the conveyor chain 3 each support bar 9 is mounted on the retaining bar 8 according to the invention by means of an offset portion 12 which is downwardly orientated on the rising conveyor stringer. The offset portion maintains the printed material support, comprising the support bars 9, at a level which corresponds to the desired conveying path of the printed material 10.

A repeatedly interrupted slide plate 13, which bridges the horizontal distance from the left-hand support bar upstream of the reversal position to the right-hand support bar 9 downstream of the reversal position is disposed between the rising conveyor stringer (left side of the chain conveyor 2) and the descending conveyor stringer (right-hand side of the chain conveyor 2) in the conveying path of the printed material 10. The interruptions 14 are provided to permit the entry of the subsequently described pusher elements or pull elements. The slide plate 13 or each slide plate section is mounted by means of a retaining part 15 on a cross-member 16 (FIG. 5). The greater part of the slide plate 13 is slightly inclined at a downward angle from left to right, that is to say in the conveying direction of the printed material, and a small frontal part 13' of the slide plate is inclined upwardly at a steeper angle to facilitate the transfer of the printed material 10. Where appropriate the slide plate according to FIGS. 11 to 14 can also be provided with a middle horizontal part 13 and a frontal part 13' which is upwardly inclined and a rear part 13'' which is downwardly inclined. Slotted spindles, supporting rollers, conveyor belts or the like can be provided in place of the slide plate or in addition thereto.

Pusher elements in the form of slides 17, whose bifurcated pusher heads 17' abut against the trailing transverse edge of the printed material 10 are used as conveying means for the printed material which passes from left to right in the embodiment according to FIGS. 1 to 6. The slides 17 are mounted on a common continuous cross-bar 18 which can be reciprocated along the longitudinally extension of the drying device by means of the piston rod 19 of a pressure medium cylinder 20 in the sense of the arrows drawn in FIGS. 2 to 5. The ends of the cross-bar 18 are guided on slide rails 21.

Figures 7, 8, 9, 10:
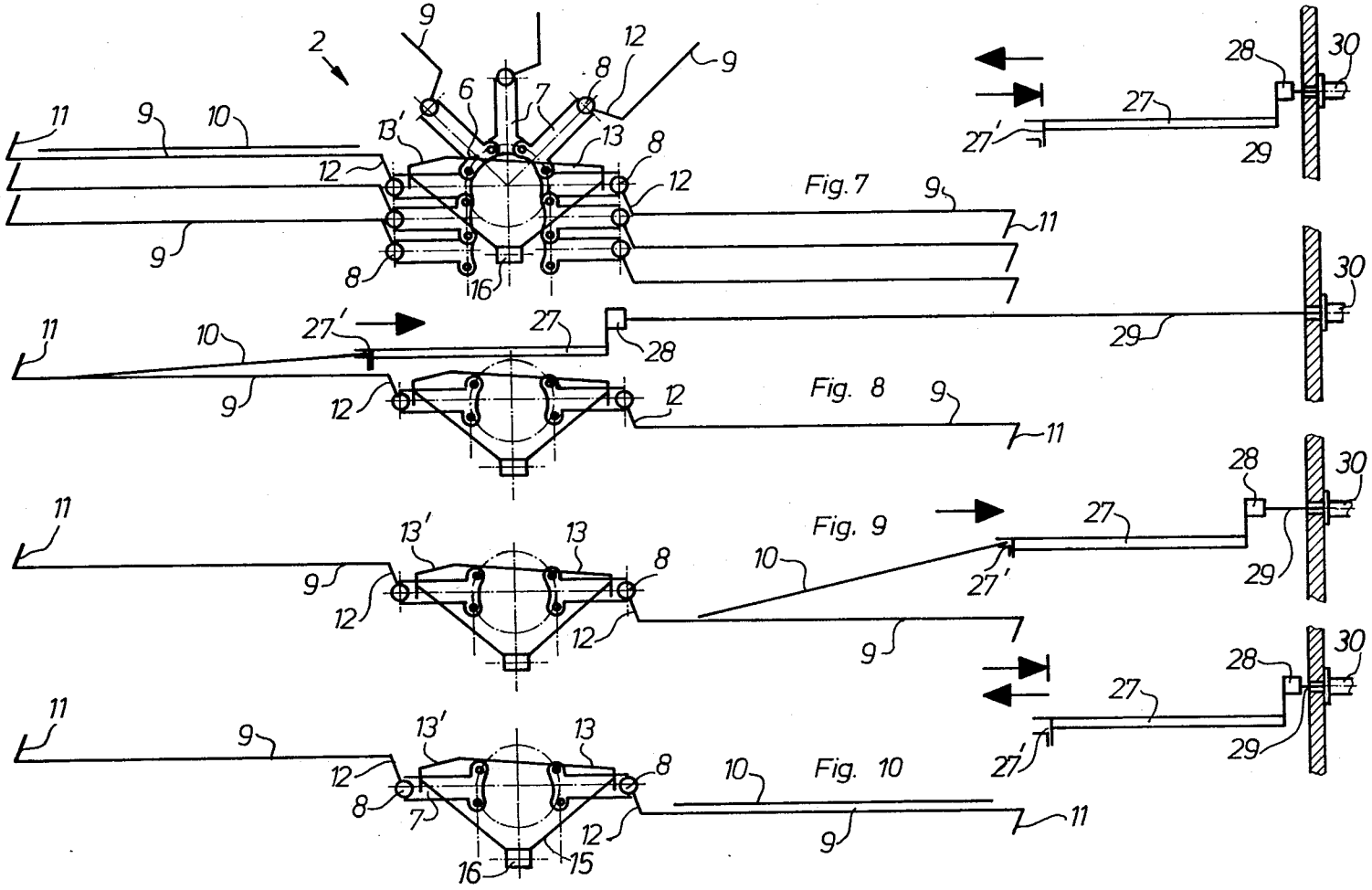
FIGS. 7 to 10 show another embodiment of the upper reversing zone of the chain conveyor with a printed material pull element in different operating positions.

All stepping and sliding motions of the chain conveyor 2 and of the slides 17 are controlled in synchronism. In FIG. 10 the printed material 10, for example a stiff sheet of paper or cardboard, is placed in readiness on the printed material support 9 which has arrived at the top left-hand side, the chain conveyor being stationary for a short time. At this moment the piston rod 19 is extended and the slide heads 17' of the slides 17 first push the printed sheet 10 according to FIG. 3 to the right over the slide plate 13 and then continuously in accordance with FIG. 4 over the top printed material support 9 of the conveyor stringer on the right-hand side. The direction of motion of the slide 17 is then reversed so that the printed sheet 10 slides or drops down on the printed material support 9 in accordance with FIG. 5. The slides 17 are then moved back by the piston rod 19 into their starting position as shown in FIG. 2. The chain conveyor carries out a further stepping motion and lifts the succeeding printed material support 9 with the printed sheet 10 disposed thereon into the standby position according to FIG. 2 whereupon this cycle is repeated.

On the left-hand side adjacent the top printed material supports 9 a pivotably supported shaft 22 has angle hooks 23 mounted thereon the upper members of the said hooks being adapted to place themselves over the stop fence edges of the support bar 9 in the position shown in solid lines in FIG. 1 in order to accurately locate the vertical position of the top printed material support while the printed sheet 10 disposed thereon is displaced. The angle hooks 23 are pivoted into their released position, shown in broken lines in FIG. 1, by the piston rod 24 of a pressure medium cylinder 25 which acts on a lever arm 26 which is associated with the shaft 22.

Pull elements in the form of grippers 27, whose tong-shaped gripper heads 27' extend over the leading edge of the printed material 10 to grip it between their correspondingly controllable gripper jaws are provided as conveying means for the printed material which moves from left to right in the embodiment of the invention illustrated in FIGS. 7 to 10. The grippers 27 are mounted on a common continuous cross-bar 28 which can be reciprocated by the piston rod 29 of a pressure medium cylinder 30.

The printed material, for example a sheet of paper or cardboard, is disposed on the uppermost left-hand printed material support 9 in the position illustrated in FIG. 7. The chain conveyor 2 is in the stop position. The grippers 27 are extended by the piston rod 29 from their inoperative position shown in FIG. 7 into the position shown in FIG. 8 and the clamping jaws of their gripper heads 27' grip the leading edge of the printed sheet 10. The grippers 27 are then moved back by the piston rod 29 to the right into the position illustrated in FIG. 9, the gripper heads 27' drawing the printed sheet 10 over the slide plate 13 on to the right-hand side of the chain conveyor 2. The clamping jaws of the gripper heads 27' are then open, the printed sheet 10 is released and drops or slides on to the top right-hand printed material support 9. The grippers 27 will then return into their starting position (FIG. 10). The chain conveyor then restarts and lifts the succeeding printed material support 9 on the left with the printed sheet 10 disposed thereon into the standby position according to FIG. 7 whereupon the conveying motion described hereinabove is repeated.

Figures 11, 12, 13, 14:
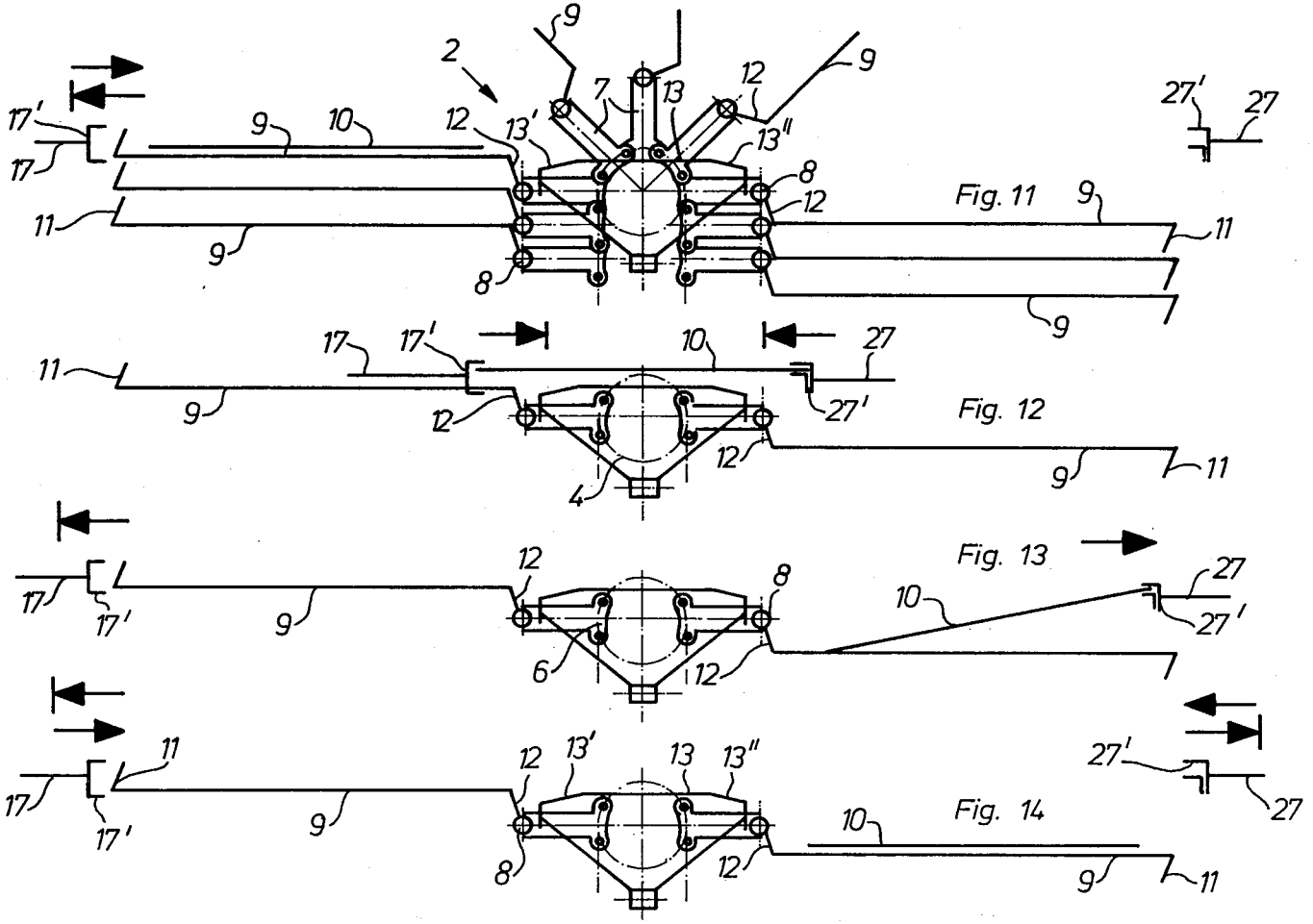
FIGS. 11 to 14 show a third embodiment of the upper reversing zone of the chain conveyor with a combination of a pusher element and a pull element for the printed material.
Figures 15, 16, 17, 18:
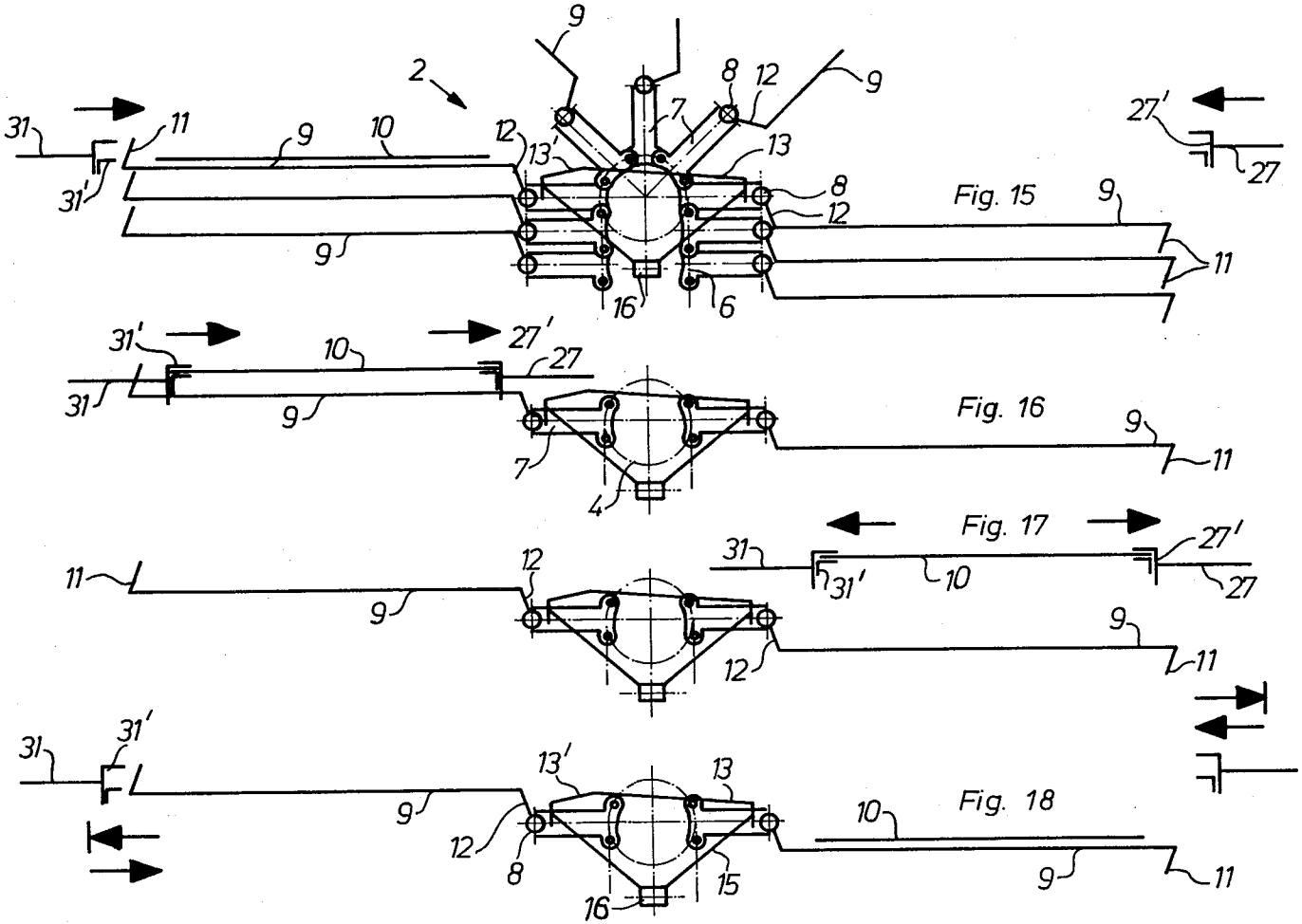
FIGS. 15 to 18 show a fourth embodiment of the upper reversing zone of the chain conveyor with a modification of the combination between a push element and a pull element for the printed material.

In the embodiment of the invention as illustrated in FIGS. 11 to 14 pusher elements in the form of slides 17 with slide heads 17' as well as pull elements in the form of grippers 27 with gripper heads 27' are used simultaneously for the printed material which passes from left to right. The slides and grippers convey the printed sheet 10 in accordance with the method of operation already explained by reference to FIGS. 1 to 6 or 7 to 10 but are required to perform only shorter pushing and pulling motions because the printed sheet 10 which is advanced by the slides 17 is already gripped by the gripper heads 27' of the grippers 27 when it is in its middle feed position (FIG. 12) and is completely pulled to the right as shown in FIGS. 13 and 14.

In the embodiment of the invention illustrated in FIGS. 15 to 18 two pull elements in the form of grippers 27 with gripper heads 27' are disposed on the right-hand side of the chain conveyor 2 and operate in accordance with the embodiment illustrated in FIGS. 7 to 10. Pusher grippers 31 with gripper heads 31′ whose clamping jaws grip and clamp the trailing edge of the printed sheet 10 are also provided on the right-hand side of the chain conveyor 2. The printed sheet 10 is therefore supported by the gripper heads 27′ and 31′ and is floatingly conveyed from left to right, a feature which may be advantageous for certain kinds of printed material.

Figure 19:
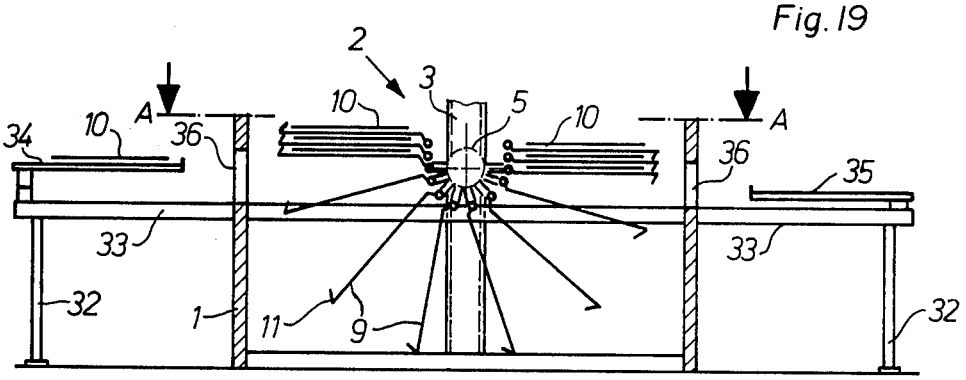
FIGS. 19 to 20 show diagrammatically the bottom reversing zone of the chain conveyor with feed and delivery elements for the printed material in two different operating positions.
Figure 20:
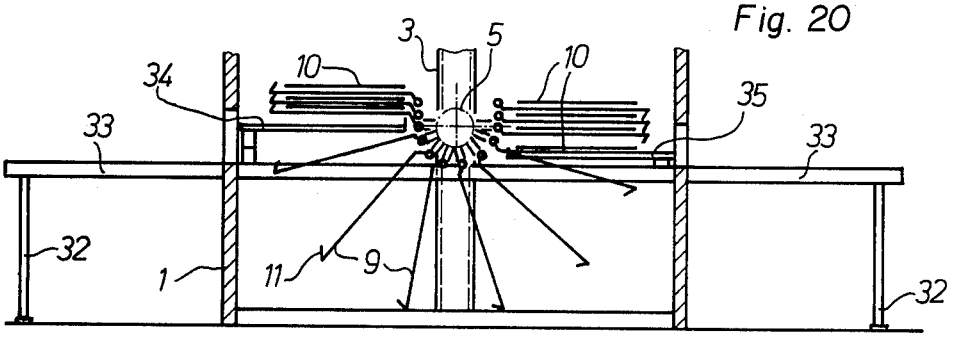
Figure 21:
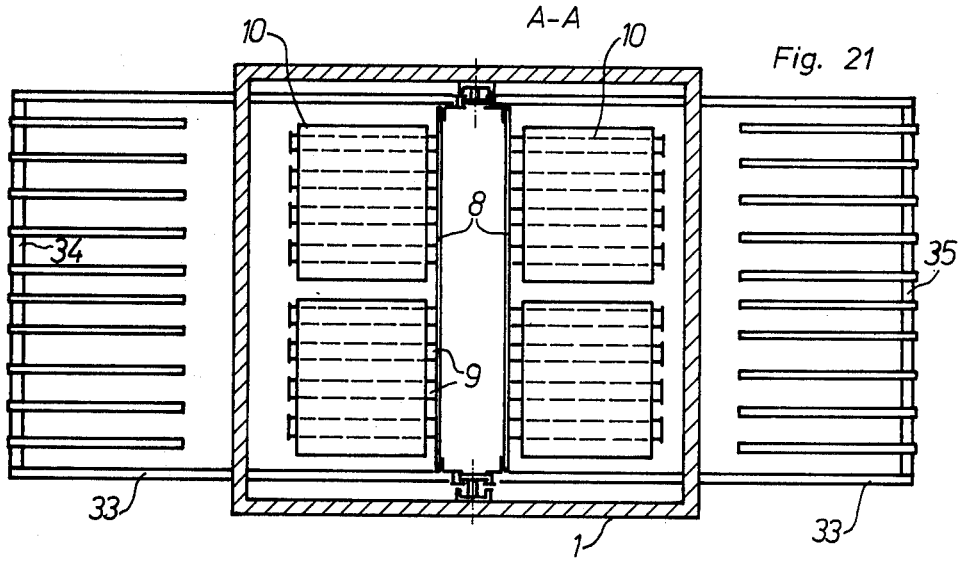
FIG. 21 is a diagrammatic view of a horizontal cross-section through the bottom part of the drier for printed material along the line A—A of FIG. 19.
Figure 22:
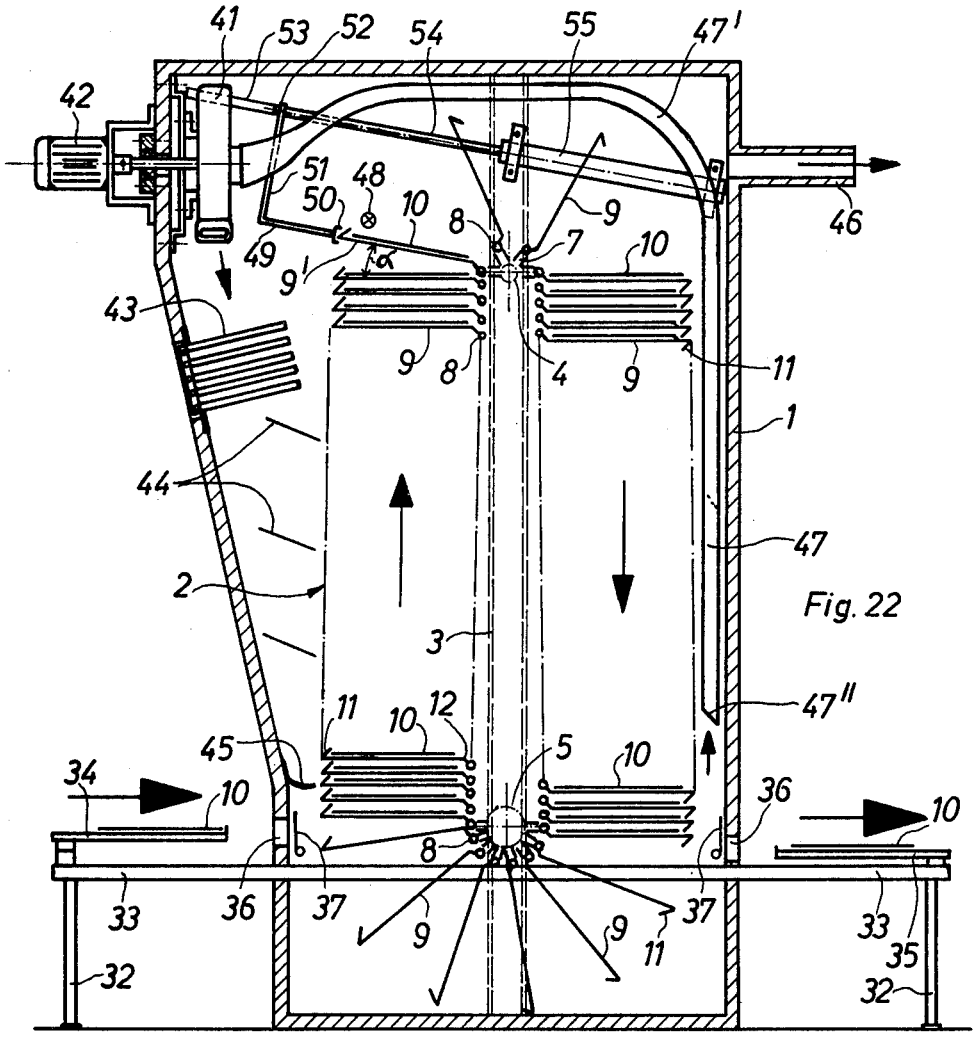
FIG. 22 is a vertical longitudinal section of another diagrammatically illustrated drier for printed material with a top rising printed material carrier inclined at an angle.
Figure 23:
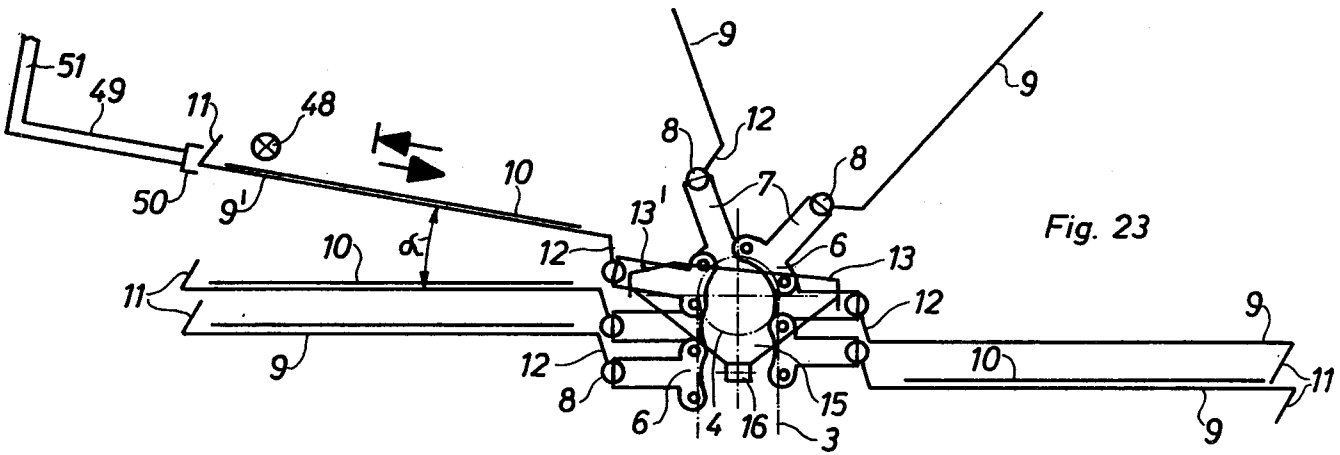
FIGS. 23 to 26 show to an enlarged scale and in diagrammatic form the top reversing zone of the chain conveyor according to FIG. 22 with a pusher element for printed material in different operating positions.
Figure 24:
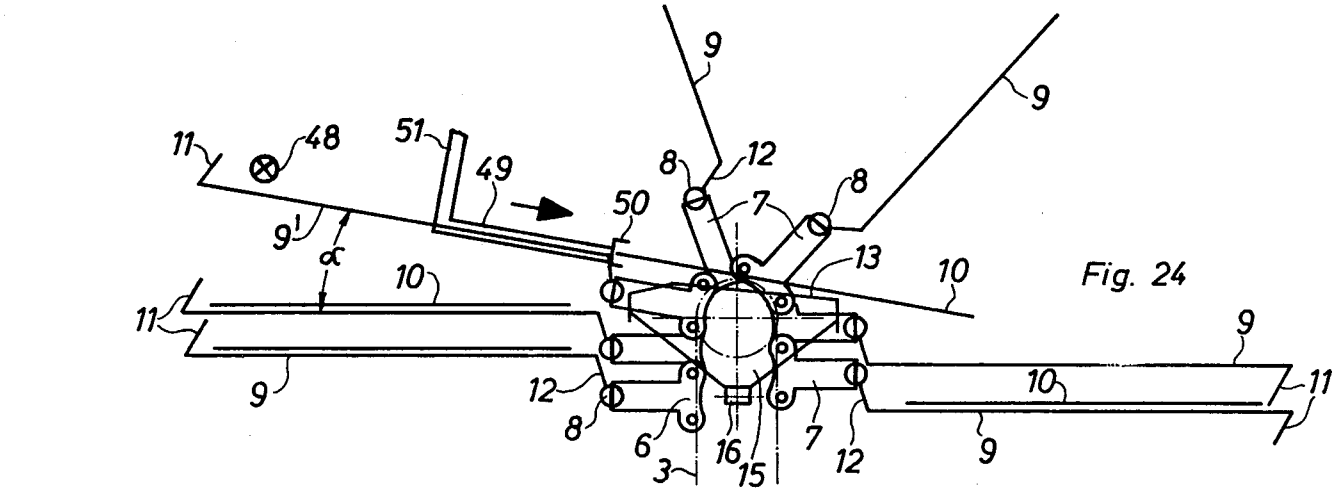
Figure 25:
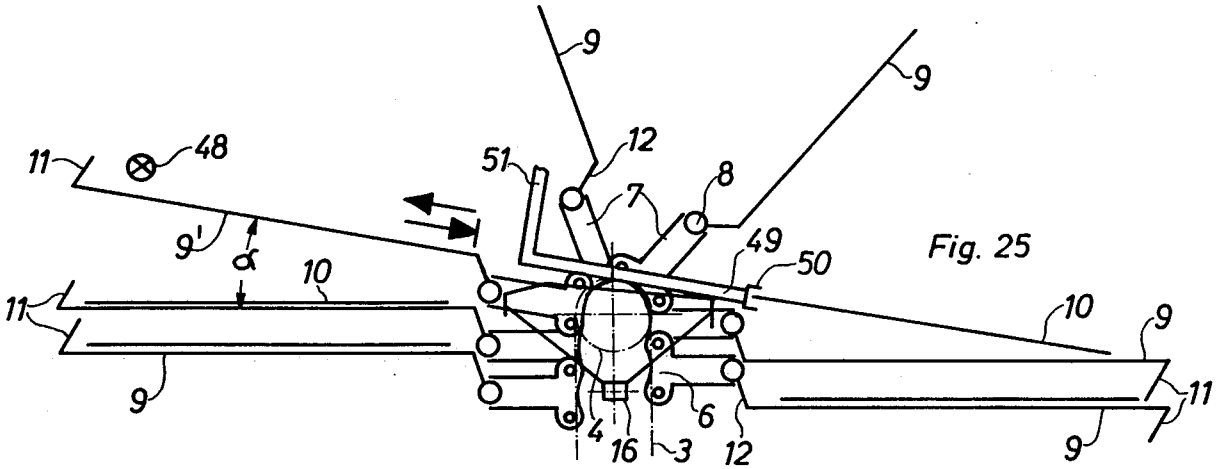
Figure 26:
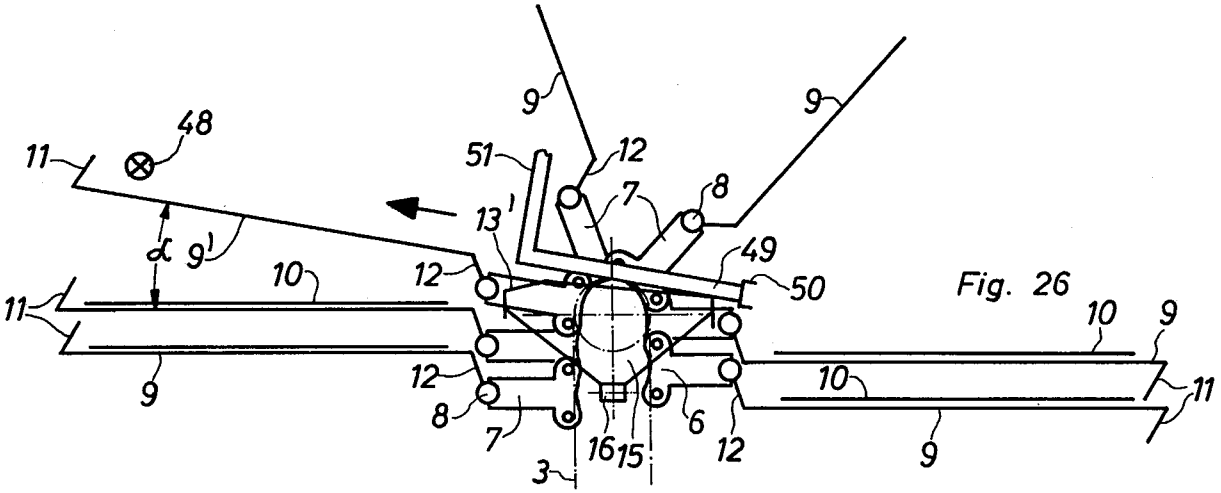
Figure 27:
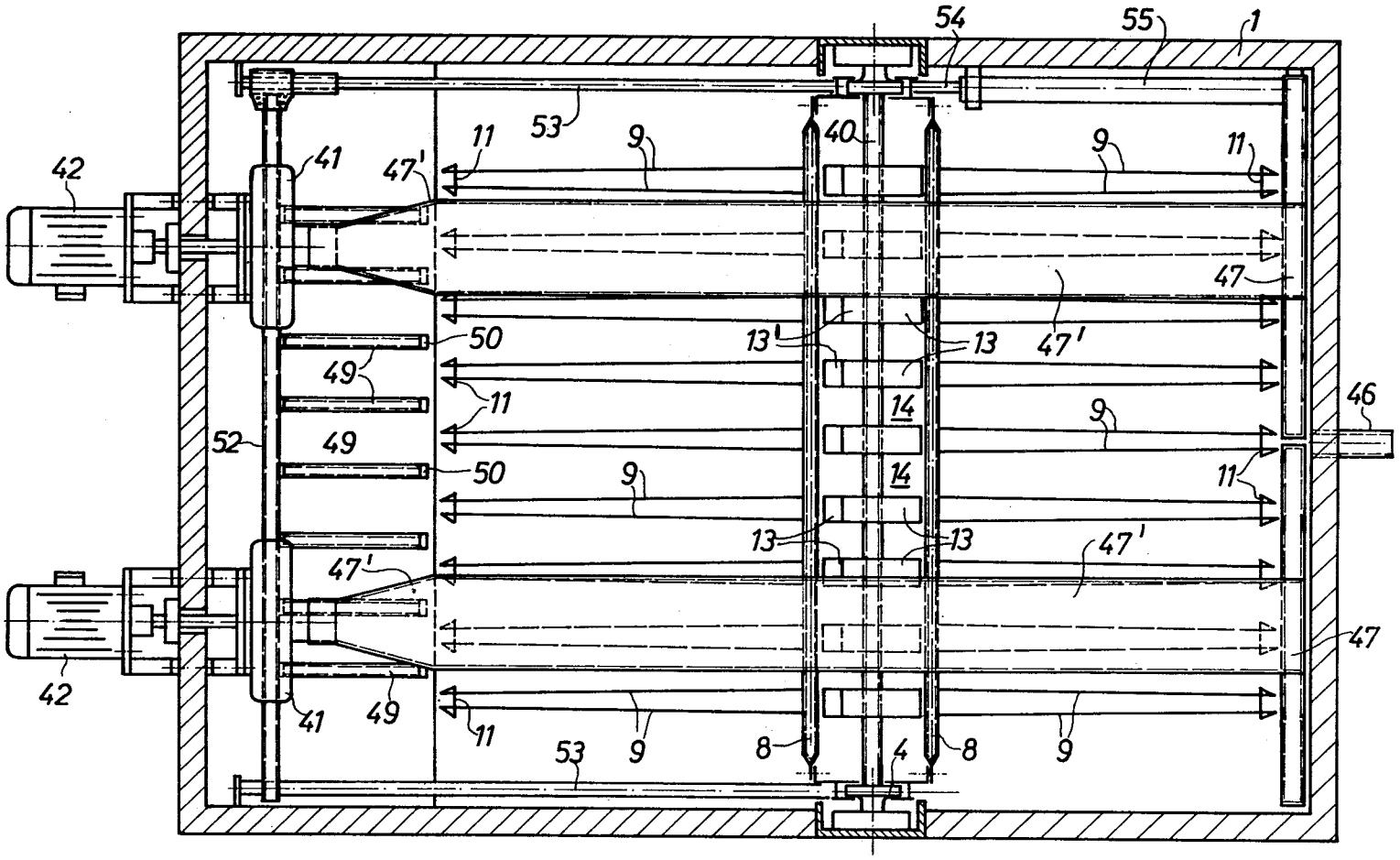
FIG. 27 is a horizontal cross-section of a plan view of the top reversing zone of the chain conveyor according to FIG. 22 with the conveying path for the printed material.
Figure 28:
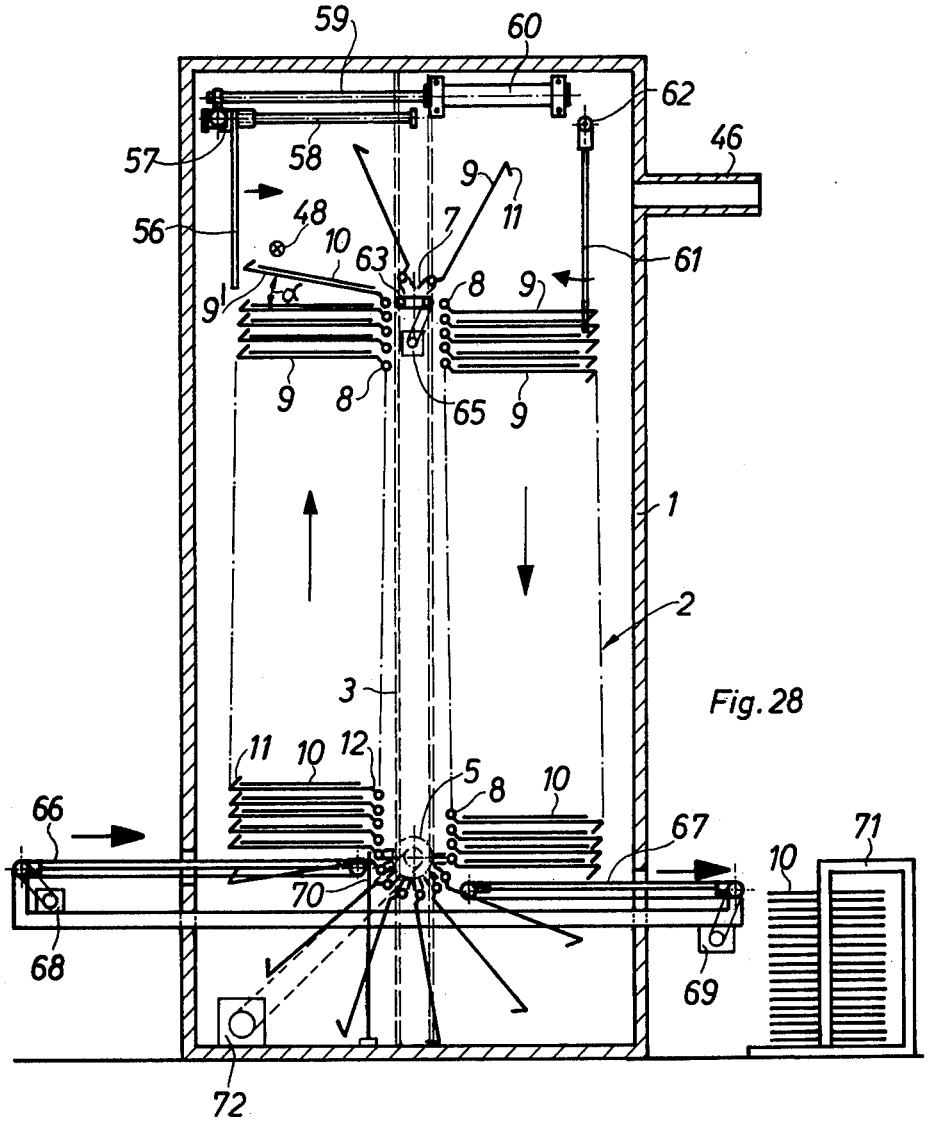
FIG. 28 is a vertical longitudinal section showing a further embodiment of the drier for printed material in which the pusher element for the printed material has a shorter stroke.

The bottom part of a drier for printed material according to the invention as illustrated in FIGS. 19 to 21 illustrates the feed and delivery of the printed material. Horizontal guide rails 33 on which supporting combs 34, 35 are slidable at the level of the bottom reversing zone of the chain conveyor 2 are disposed on supports 32 on the left-hand and right-hand side of the drier housing 1. The support combs move in opposite directions at the rhythm of the chain conveyor motion while entering through lateral slits 36 into the interior of the heated drier housing 1. As shown in FIG. 1 the slits 36 can be closed by means of pivotably supported spring-biased flaps 37 which are automatically operated by the inwardly moving and outwardly moving combs 34, 35.

FIG. 19 shows the two support combs 34, 35 in the extended state, the support comb 34 being occupied by a printed sheet 10. The support combs 34, 35 then move simultaneously at a rhythm into the drier housing 1, the combs extending between the support bars 9. The chain conveyor 2 then moves through one step, the printed sheet 10, which has moved into the drier housing, is entrained and raised by the support bars 9 of the affected rising printed material support which extends through the support comb 34 while the support bars of the corresponding descending printed material support on the right-hand side of the drier extend through the support comb 35 to deliver the dried printed sheet thereon. This operation is illustrated in FIG. 20. The two support combs 34, 35 simultaneously again move to the outside.

The drier interior is heated in any desired manner, for example by means of heating pipes 39 which are indicated in FIG. 1 on the drier floor 38 or by means of a hot air blower.

The embodiment of the drier for printed material according to FIGS. 22 to 27 is constructed in accordance with FIGS. 1 to 7 as regards the parts 1 to 35. The drier is provided with a circulating air heating system which can be regulated. Two air blowers 41, which are driven by means of motors 42, are disposed in the top part of the housing 1 on the left-hand side thereof which is upwardly expanded. The blowers 41 blow the air in the housing downwardly while the said air flows through built-in heating elements 43. The heated air is conducted through the chain conveyor 2 over the printed material 10 to be dried by passing through the chain conveyor 2 between the printed material supports 9. The air is partially discharged on the opposite side of the housing 1 through an air exit 46 and partially drawn in through air shafts 47 to be returned into the blowers 41. The vertical air shafts 47 converge upwardly and merge at the top into the approximately horizontal duct 47′ which extends to the blower 41. The air shafts 47 can be provided with lateral suction openings in addition to the bottom opening 47″. Fresh air can enter into the housing 1 through lateral louvers 36 which are disposed at the bottom.

According to the invention the printed material 10 is conveyed by the rising conveyor stringer to the descending conveyor stringer in the upper reversing zone of the chain conveyor only when the uppermost printed material support of the rising conveyor stringer of the chain conveyor 2 is in a position which is downwardly inclined towards the descending conveyor stringer as can be seen by reference to the drawing. The angle of inclination $\alpha$ of the top printed material support 9′ in relation to the printed material support 9 which is disposed horizontally therebelow is limited downwardly by the minimum mutual distance which must exist between the said printed material supports 9′, 9 to ensure that the printed material 10 is conveyed with absolute reliability and without physical contact. At the top the angle of inclination $\alpha$ is limited by the gap between the surface of the printed material support 9′ and the retaining bar 8 of the printed material support 9 which has already moved to the top. An angle of inclination $\alpha = 10°$ may be sufficient if it is anticipated that a sheet of printed material or a panel of printed material is able to curve upwardly by a maximum of approximately 20 mm above the printed material support 9.

The circulating motion of the chain conveyor 2 must be stopped during operation when the uppermost printed material support 9′ has reached the desired angle of inclination $\alpha$. In an advantageous embodiment of the invention the stopping operation can be performed by the printed material support 9′ itself, for example by means of a switch or by means of a photocell 48.

In the embodiment according to FIGS. 22 to 27 the pusher elements comprise slides 49 which are inclined at an angle and whose free ends are provided with bifurcated slide heads 50 which abut against the trailing transverse edge of the printed material 10. The slides 49 are mounted by means of retaining rods 51 on a common continuous transverse bar 52 both of whose ends are supported on slide rails and which can be reciprocated by the piston rod 54 of a pressure medium cylinder 55 in the longitudinal orientation of the drying device in the sense of the arrows drawn in FIGS. 23 to 26. The slides 49 move along the inclined plane of the uppermost printed material support 9′. The slide rail 53 and the pressure medium cylinder 55 are also inclined at an angle, i.e. parallel to the printed material support 9′.

All stepping motions of the chain conveyor and all thrust motions of the slides 49 are controlled in synchronism. According to FIG. 23 the printed material 10, for example a stiff sheet of paper or cardboard, is disposed in readiness on the inclined printed material support 9′ of the conveyor stringer on the left-hand side, the chain conveyor being briefly stopped. At this moment the piston rod 54 is retracted to the right into the pressure medium cylinder 55 and the slide heads 50 of the slides 49 initially push the printed sheet 10 according to FIG. 24 to the right over the slide plate 13 and then continuously over the uppermost printed material support 9 of the conveyor stringer on the right-hand side in accordance with FIG. 25. The piston rod 54 is then again extended to the left so that the direction of motion of the slides 49 is reversed. The printed sheet 10 will then drop or slide on to the printed material support 9 in accordance with FIG. 26. The slides 49 are moved back by the piston rod 54 into their starting position according to FIG. 23. The chain conveyor 2 performs a further operating step and lifts the succeeding printed material support with the printed sheet 10 disposed thereon into the inclined standby position according to FIG. 23 whereupon the cycle is repeated.

In the embodiment illustrated in FIGS. 28 to 32 the pusher elements comprise simple, vertically disposed push rods 56 which are mounted on a common transverse rod 57. Both ends of the transverse rod 57 are slidably supported on the slide bars 58 and are connected to the piston rod 59 of a pressure medium cylinder 60. On the side of the housing 1 opposite the push rods 56 and in the zone of the free end of the uppermost horizontal printed material support 9 there are stop bars 61 which are mounted on a common pivotably supported shaft 62. The position of the stop bars 61, adapted to pivot in the manner described above, is adjustable in accordance with the length of the printed material 10. The bottom ends of the stop bars 61 extend between the ends of the support bars 9 so that the printed material 10 abuts against the stop bars and is stopped thereby.

Inclined conveyor belts 63, which circulate through rotatably supported rollers or shafts 64 and can be driven, for example by a motor 65, are disposed between the inclined uppermost printed material support 9' of the rising conveyor stringer and the uppermost printed material support 9 of the descending conveyor stringer of the chain conveyor 2. If paper sheets 10 are conveyed the conveyor belts 63 can be provided with suction apertures and can be adapted to circulate over a vacuum box. If stiff cardboard or panels are conveyed it may be possible to provide simple slide plates instead of conveyor belts, such slide plates being similar to the slide plate 13 of the embodiment illustrated in FIGS. 22 to 27.

Printed material is fed in and delivered in accordance with FIG. 8 by means of circulating conveyor belts 66 or 67 which are driven by motors 68 or 69. The conveyor belts 66 and 67 comprise a plurality of narrow parallel individual belts which engage in the spaces between the support bars 9. The incoming printed sheets 10 are stopped by adjustable stop bars 70. The delivered printed sheets 10 can be collected on a stacking device 71. FIG. 21 finally also indicates a motor 72 which imparts rotation to the bottom chain sprockets 5 of the chain conveyor 2.

Figure 29:
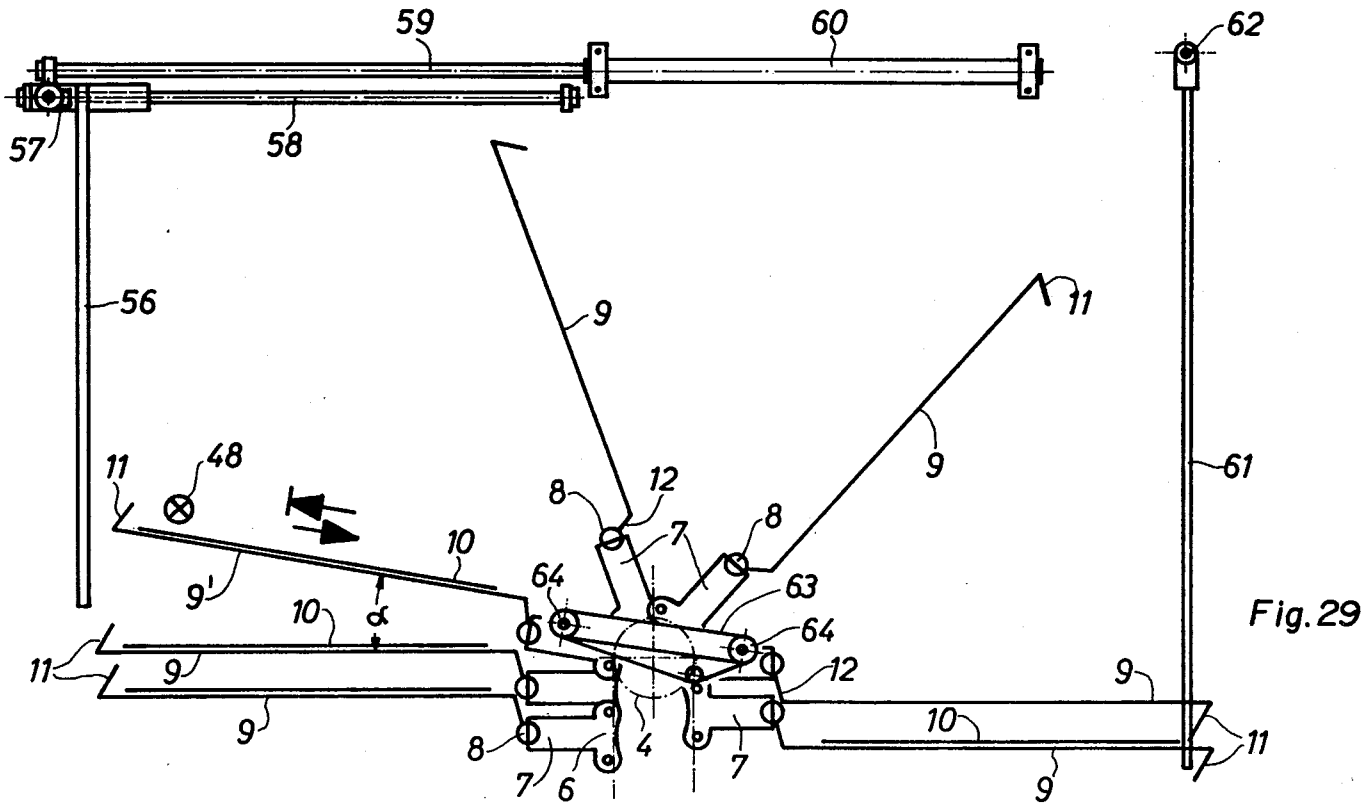
FIGS. 29 to 31 show to an enlarged scale the top reversing zone of the chain conveyor according to FIG. 28 with the pusher elements for printed material in different operating positions.
Figure 30:
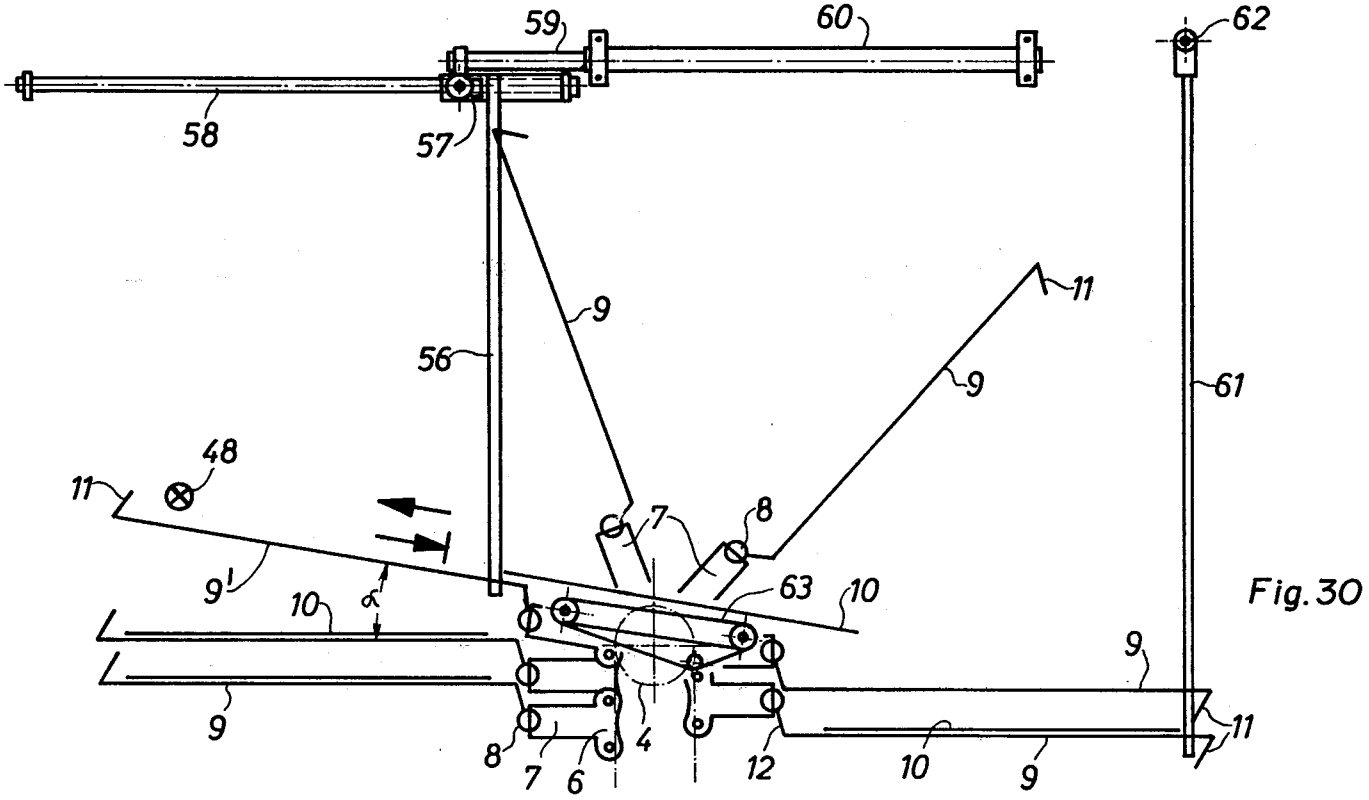
Figure 31:
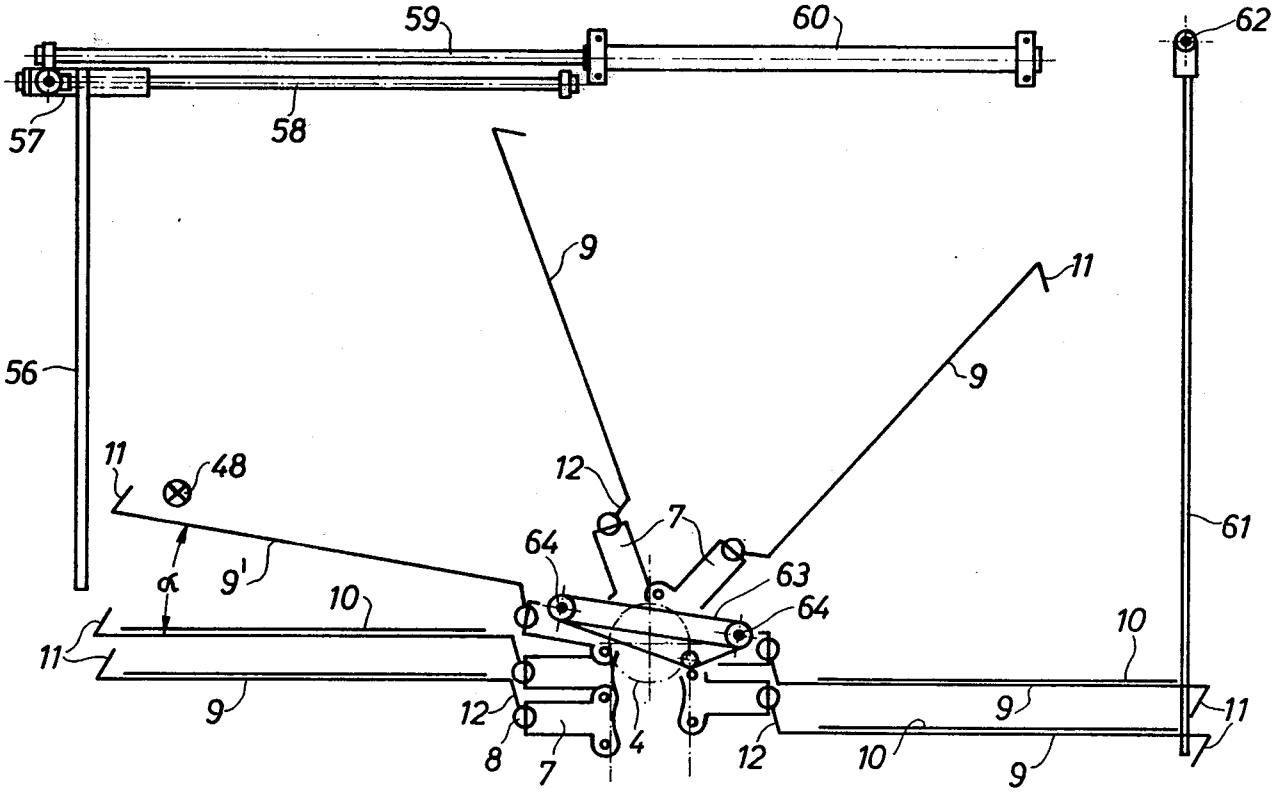
Figure 32:
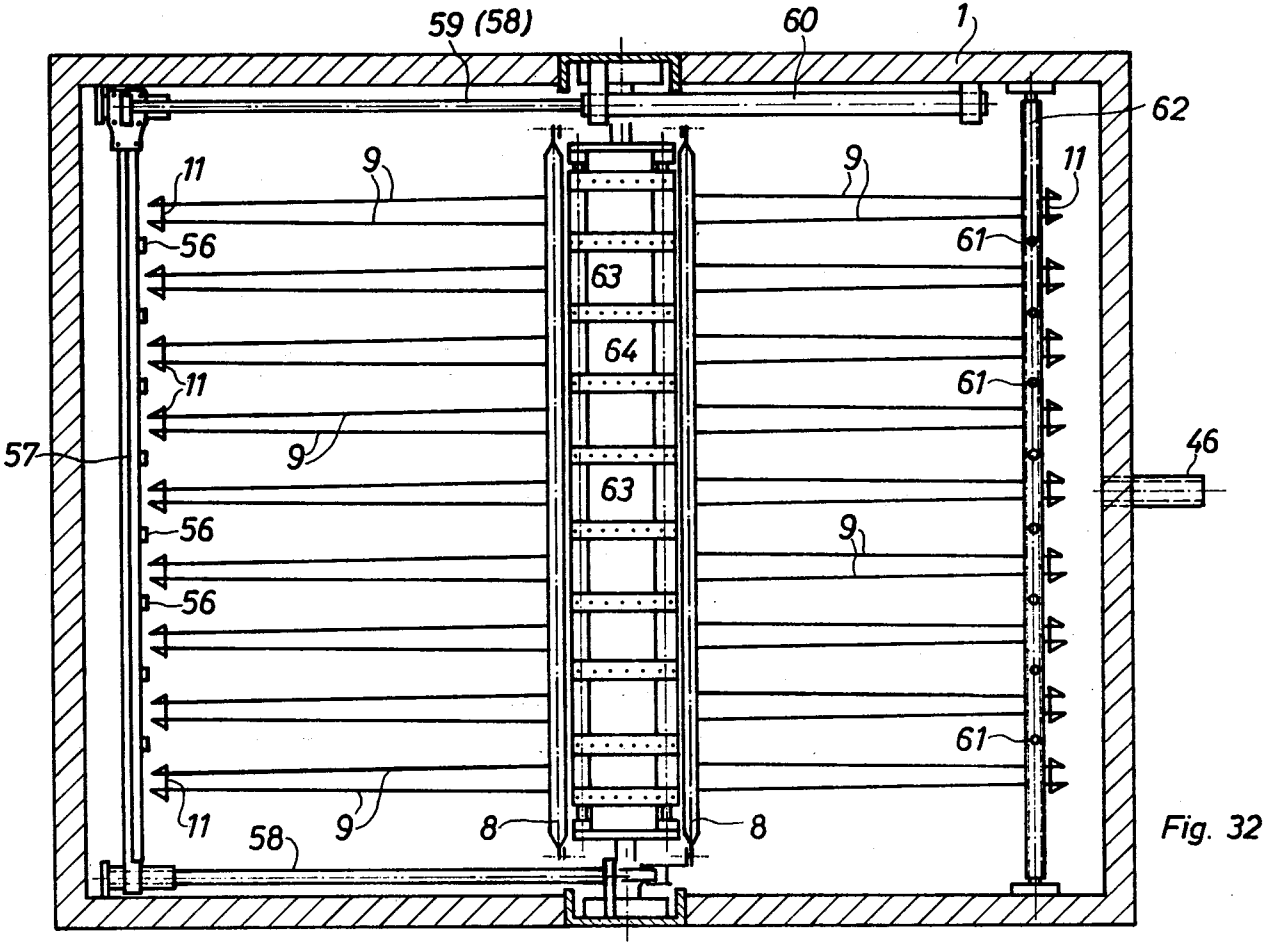
FIG. 32 is a horizontal cross-section of a plan view of the top reversing zone of the chain conveyor according to FIG. 28 showing the conveying path of the printed material.

The method of operation of the drier for printed material as described hereinabove can be easily understood by reference to FIGS. 29 and 31. If the printed material support 9' according to FIG. 29 has arrived in its inclined position the motion of the chain conveyor 2 is automatically stopped. The push rods 56 are then drawn by the piston rod 59 of the pressure medium cylinder to the right into the position illustrated in FIG. 30. The push rods 56 will then abut against the left-hand transverse edge of the printed material 10 and push it with appropriate acceleration over the conveyor belts 63 as shown in FIG. 30. The conveyor belts 63 then convey the printed material 10 to the top printed material support 9 on the other side of the chain conveyor as shown in FIG. 31. At the same time, the push rods 56 are again pushed back to the left into their starting position. The chain conveyor 2 is then again automatically set in motion and a new cycle begins.

The invention is of course not confined to the embodiments described hereinabove and illustrated in the accompanying drawing but comprises all other modifications within the scope of the essential features of the invention.

I claim:

1. Apparatus for drying flat printed material such as paper and card sheets, plastic film or panels of board, timber, sheet metal or other material with printed material supports mounted on chain links connected to conveyor chains provided on a substantially upright chain conveyor means defining rising and falling conveyer stringers, an upper portion of said chain conveyor means provides a transfer path for said material wherein the material is transferred laterally from a rising conveyer stringer to a falling conveyer stringer, said transfer path including conveying means which comprise pull elements which can be reciprocated in the conveying plane for acting on the leading ends of the printed material so as to pull the printed material over the conveying path from said rising to said falling conveyer stringer.

2. Apparatus according to claim 1, characterized in that the pull elements comprise grippers having gripper heads.

3. Apparatus according to claim 2, characterized in that the gripper heads are provided with adjustable clamping jaws which are pneumatically controlled in accordance with the movement of the conveyor.

4. Apparatus according to claim 1, characterized in that the pull elements are mounted on a common slidably supported transverse bar which is moved by a driving element comprising a pressure medium cylinder having a piston rod.

5. Apparatus according to claim 1, characterized in that pusher elements as well as the pull elements are combined with each other as conveying means.

6. Apparatus according to claim 2, characterized in that the grippers and the gripper heads are disposed on both sides of the conveying path of the printed material.

7. Apparatus according to claim 6, characterized in that slide plates are arranged in the middle zone of the conveying path for the printed material and are provided with interruptions for admittance of the slides or the grippers.

8. Apparatus according to claim 7, characterized in that the slide plates are inclined at a rising angle in the leading conveying direction and at a falling angle in the trailing conveying direction.

9. Apparatus according to claim 1, characterized in that the printed material supports comprise support bars provided with offset portions.

10. Apparatus according to claim 1, characterized in that the printed material supports comprise support bars provided with bent stop fence edges.

11. Apparatus according to claim 1, characterized in that an adjustable stop element comprising a pivotable angle hook is provided in the zone of an uppermost rising printed material support.

12. Apparatus according to claim 1, characterized by the provision of oppositely slidable support combs on both sides of a bottom reversal zone of the chain conveyor for the feed and delivery of the printed material.

13. Apparatus according to claim 12, characterized in that the apparatus is enclosed by a drier housing, the walls of the drier housing being provided with lateral slits for the inward and outward sliding of the support combs, the slits being closable by means of pivotably supported and spring-biased flaps.

14. Apparatus according to claim 13, characterized in that an uppermost printed material support of the rising conveyor stringer of the chain conveyor is downwardly inclined towards a descending conveyor stringer at an angle of inclination in relation to a horizontally downwardly disposed succeeding printed material support while the printed material is conveyed.

15. Apparatus according to claim 14, characterized in that inclined, circulating conveyor belts are disposed between the inclined uppermost printed material support of the rising conveyor stringer and the uppermost printed material support of the descending conveyor stringer of the chain conveyor.

16. Apparatus according to claim 14, characterized in that the uppermost printed material support of the rising conveyor stringer co-operates with switching elements comprising a photocell adapted to stop the motion of the chain conveyor when the printed material support has reached the desired inclined position.

17. Apparatus according to claim 14, characterized by the provision of adjustable stop bars in the zone of the free end of the uppermost horizontal printed material support of the descending conveyor stringer.

18. Apparatus according to claim 14, characterized by the provision in the drier housing of a circulating air heating system.

19. Apparatus according to claim 14, characterized in that circulating conveyor belts for feeding or delivering the printed material are provided at the bottom end of the drier.

* * * * *